US007753677B2

(12) United States Patent
Berenbrink et al.

(10) Patent No.: US 7,753,677 B2
(45) Date of Patent: Jul. 13, 2010

(54) BURNER

(75) Inventors: Peter Berenbrink, Oberhausen (DE); Malte Blomeyer, Mülheim an der Ruhr (DE); Werner Krebs, Mülheim an der Ruhr (DE); Bernd Prade, Mülheim an der Ruhr (DE); Holger Streb, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 902 days.

(21) Appl. No.: 10/525,779

(22) PCT Filed: Aug. 20, 2003

(86) PCT No.: PCT/EP03/09222

§ 371 (c)(1),
(2), (4) Date: Sep. 30, 2005

(87) PCT Pub. No.: WO2004/025183

PCT Pub. Date: Mar. 25, 2004

(65) Prior Publication Data

US 2006/0035188 A1 Feb. 16, 2006

(30) Foreign Application Priority Data

Sep. 2, 2002 (EP) ..... 02019530

(51) Int. Cl.
*F23D 14/26* (2006.01)
*F23D 14/62* (2006.01)

(52) U.S. Cl. ..... 431/183; 431/8; 431/9; 431/181; 431/182; 431/284; 431/285

(58) Field of Classification Search ..... 431/8, 431/9, 10, 181, 182, 183, 184, 187, 350, 431/114, 284, 285; 60/722, 737, 738, 748, 60/749, 751; 239/398, 403, 404, 405
See application file for complete search history.

(56) References Cited

U.S. PATENT DOCUMENTS

| | | | | | |
|---|---|---|---|---|---|
| 746,525 | A | * | 12/1903 | Knobbs | 431/183 |
| 1,086,715 | A | * | 2/1914 | Irish | 431/183 |
| 1,102,510 | A | * | 7/1914 | Irish | 431/183 |
| 1,126,654 | A | * | 1/1915 | Peabody | 431/183 |
| 5,511,375 | A | | 4/1996 | Joshi et al. | |
| 5,647,200 | A | * | 7/1997 | Althaus | 60/39.17 |
| 6,092,363 | A | | 7/2000 | Ryan | |
| 6,152,724 | A | * | 11/2000 | Becker | 431/9 |
| 6,684,641 | B2 | * | 2/2004 | Moriya et al. | 60/737 |
| 6,691,518 | B2 | | 2/2004 | Doebbeling et al. | |

FOREIGN PATENT DOCUMENTS

| | | | |
|---|---|---|---|
| DE | 196 40 818 | A1 | 4/1998 |
| DE | 199 48 673 | A1 | 4/2001 |
| EP | 0 672 865 | A2 | 9/1995 |
| EP | 0 870 989 | A2 | 10/1998 |
| EP | 0 902 237 | A2 | 3/1999 |
| EP | 1 207 350 | A2 | 5/2002 |
| EP | 1235033 | A2 | 8/2002 |
| JP | 07332621 | A | 12/1995 |
| JP | 2002513458 | A | 5/2002 |
| WO | WO 02/052201 | A1 | 7/2002 |

* cited by examiner

*Primary Examiner*—Carl D Price

(57) ABSTRACT

Burners in prior art exhibit combustion instabilities in certain ranges. The operating range of burners is restricted by said instabilities. In an inventive burner, the combustible has a concentration distribution, whereby the concentration of the combustible reduces in a radial direction from the interior to the exterior.

10 Claims, 5 Drawing Sheets

BURNER

CROSS REFERENCE TO RELATED APPLICATION

This application is the U.S. National Stage of International Application No. PCT/EP2003/009222, filed Aug. 20, 2003 and claims the benefit thereof. The International Application claims the benefits of European Patent application No. 02019530.1 EP filed Sep. 2, 2002, both of the applications are incorporated by reference herein in their entirety.

FIELD OF THE INVENTION

The invention relates to a burner according to the preamble clause of the independent claims.

BACKGROUND OF THE INVENTION

The operating range of burners with premixtures, in particular in gas turbines, is limited by self-excited combustion oscillations. Combustion instabilities of this kind can be suppressed actively, for example by increasing the power of the pilot flame, or passively, for example by means of resonators.

SUMMARY OF THE INVENTION

The object of the invention is therefore to demonstrate a burner in which a stable range for combustion is extended in a simple manner.

The object is achieved by a burner according to the claims. Further advantageous embodiments of the burner are listed in the dependent claims.

DETAILED DESCRIPTION OF THE INVENTION

Figure 1:
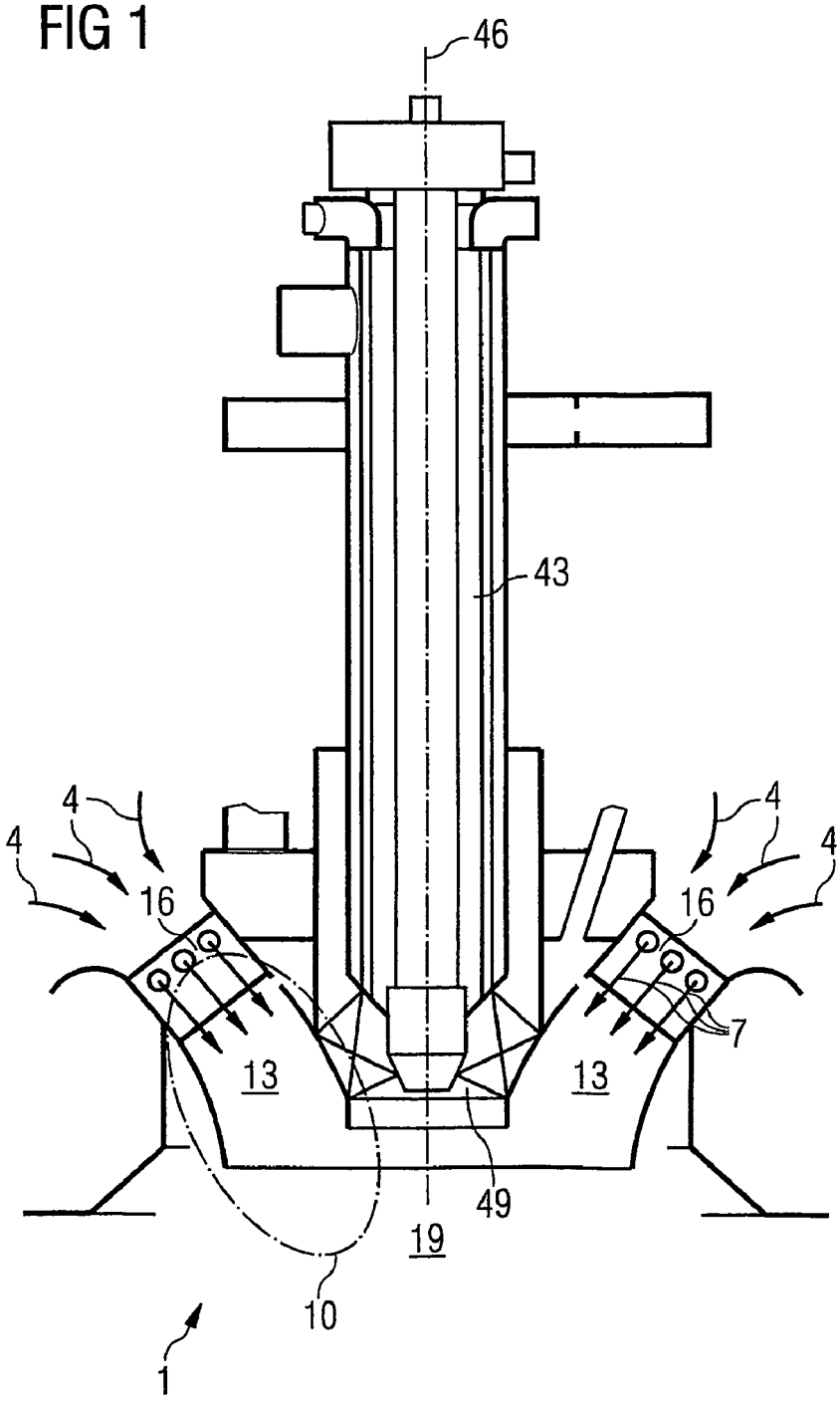
FIG. 1 shows a burner.

FIG. 1 shows a burner 1, in particular a premix burner 1, in particular for a gas turbine. The burner 1 has a burner longitudinal axis 46. A diffusion or pilot burner 43 is arranged for example centrally along the burner longitudinal axis 46. In premix operation the pilot burner 43 is operated to support the burner 1.

At a radial end 49 of the diffusion burner 43, fuel 7 and/or air 4 is supplied to a premix section 10 and/or a combustion chamber 19 via a channel 13 (FIG. 6) which is for example annular in shape with respect to the longitudinal axis 46. Instead of air it is also possible to supply oxygen or another gas which produces a combustible fuel-gas mixture in combination with the fuel 7.

For example, first air 4 is supplied to the channel 13 and then the fuel 7.

The air 4 flows in the channel 13 for example at least past one swirl blade 16, whereby the swirl blade 16 supplies for example fuel 7 to the channel 13.

Figure 6:
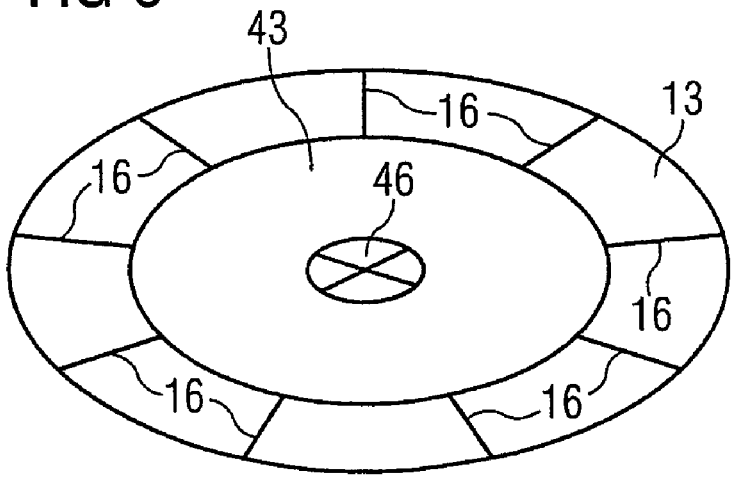
FIG. 6 shows a section along the line VI-VI in FIG. 2.

The swirl blades 16 are disposed for example annularly, in particular equidistantly, around the burner longitudinal axis 46 (FIG. 6).

The air 4 and the fuel 7 mix together in the premix section 10, which is indicated by dashed lines.

It is, however, also possible for the fuel 7 to be supplied first in the channel 13, and then the air 4.

Figure 2:
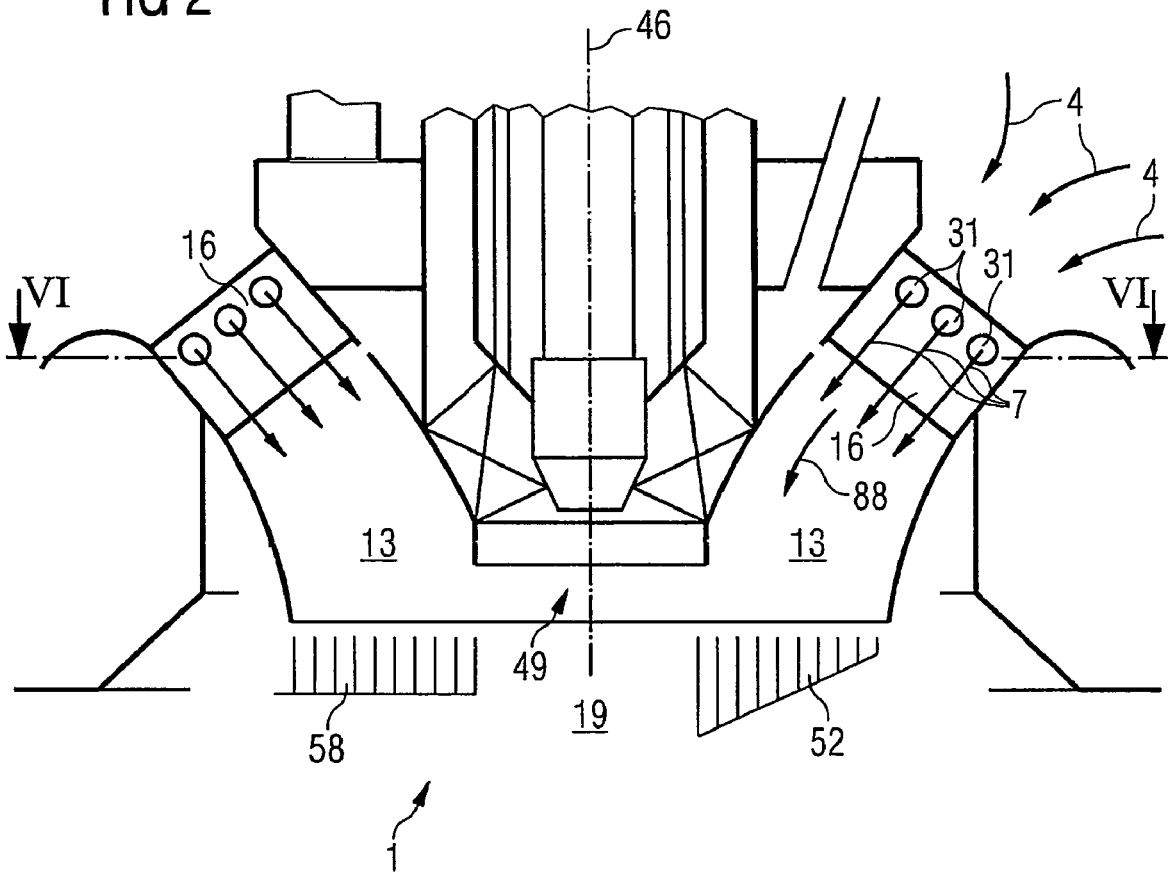
FIG. 2 shows an enlarged section from FIG. 1.

FIG. 2 shows the radial end 49 of the diffusion/pilot burner 43 with the annular channel 13.

The fuel 7 is supplied to the channel 13 via at least two fuel nozzles 31 and flows there in a flow direction 88. The fuel is preferably supplied via fuel nozzles 31 which are disposed in the swirl blade 16.

The fuel 7 can also be supplied to the channel 13 via other distribution units.

The combustion instabilities are produced as a result of a distribution of the fuel concentration 58 according to the prior art. In the radial direction 55, i.e. perpendicularly with respect to a longitudinal axis 46, the concentration of the fuel is approximately equal in size.

By means of an inventive distribution 52 for the fuel concentration, which is not constant in the radial direction 55 at at least one instant in time during the operation of the burner 1, the strength of the combustion oscillations is reduced.

Thus, the operating range for the burner 1 can be extended. Viewed for example in the radial direction 55, the fuel concentration varies starting from the center, i.e. from the burner longitudinal axis 46, outward; in particular the fuel concentration decreases or increases for example linearly. A non-linear decrease or increase can also be present, however.

Figure 3:
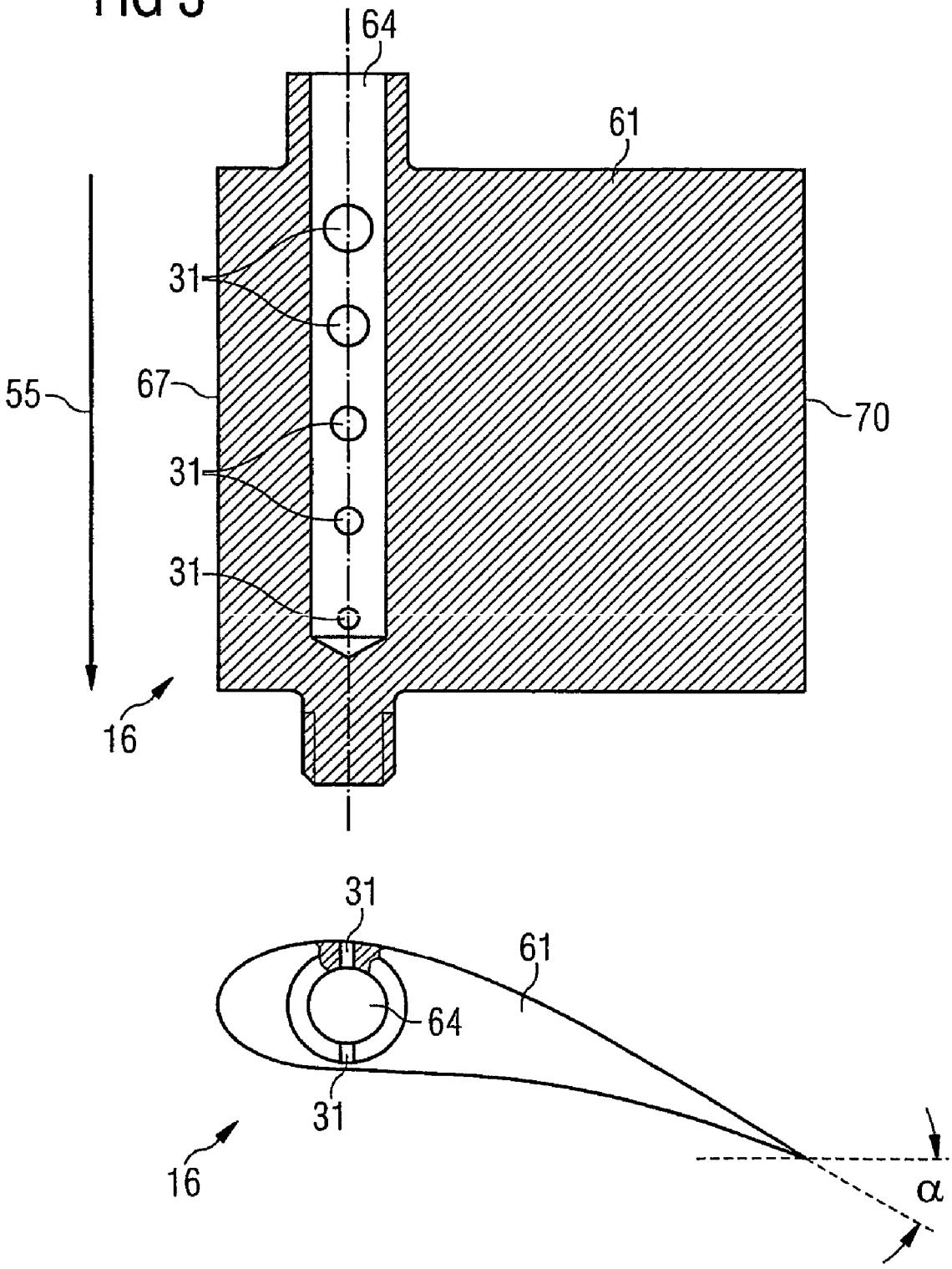
FIGS. 3*a* and 3*b* shows a swirl blade for a burner embodied according to the invention.

FIGS. 3*a* and 3*b* show shows a swirl blade 16 by means of which this can be implemented.

The operating range can also be extended if an outflow angle $\alpha$ of a medium, i.e. the angle between resulting velocity and circumferential velocity (FIG. 5), for example of the air 4/fuel 7 mixture, has a distribution similar to the concentration of the fuel 7, i.e. viewed from the burner longitudinal axis 46, the outflow angle $\alpha$ decreases for example in a radial direction 55 from a maximum value to a minimum value or vice versa. This happens for example as a result of a winding of the swirl blade 16 as described in FIGS. 4*a*, 4*b* and 4*c*

The outflow angle $\alpha$ is also the angle between the flow direction of the medium flowing in the channel (air, oxygen, fuel, mixtures thereof) and a plane whose normal is the burner longitudinal axis 46.

The distribution 52 of the fuel concentration and the outflow angle $\alpha$ can also be simultaneously combined with each other in order to extend and improve the operating range of the burner 1.

FIGS. 3*a* and 3*b* show shows a swirl blade 16 for a burner 1 according to the invention.

The swirl blade 16 has a leading edge 67 and a trailing edge 70. In the channel 13 the medium flows in the flow direction 88 first past the leading edge 67 and then past the trailing edge 70.

In the area of the leading edge 67 there is present a core 73 in which a supply 64 for fuel 7 is present. The supply 64 is for example a blind hole. Viewed in the radial direction 55, parallel to the trailing edge 70, holes are present in the supply 64 which represent the fuel nozzles 31.

The fuel 7 reaches the channel 13 through these fuel nozzles 31. The diameters of the holes of the fuel nozzles 31 of the swirl blade 1 installed in the burner vary in the radial direction 55 according to the concentration distribution 52 and decrease viewed for example in the radial direction 55 from the interior to the exterior.

The medium which flows past the swirl blade 16 has an outflow angle α.

Figure 4:
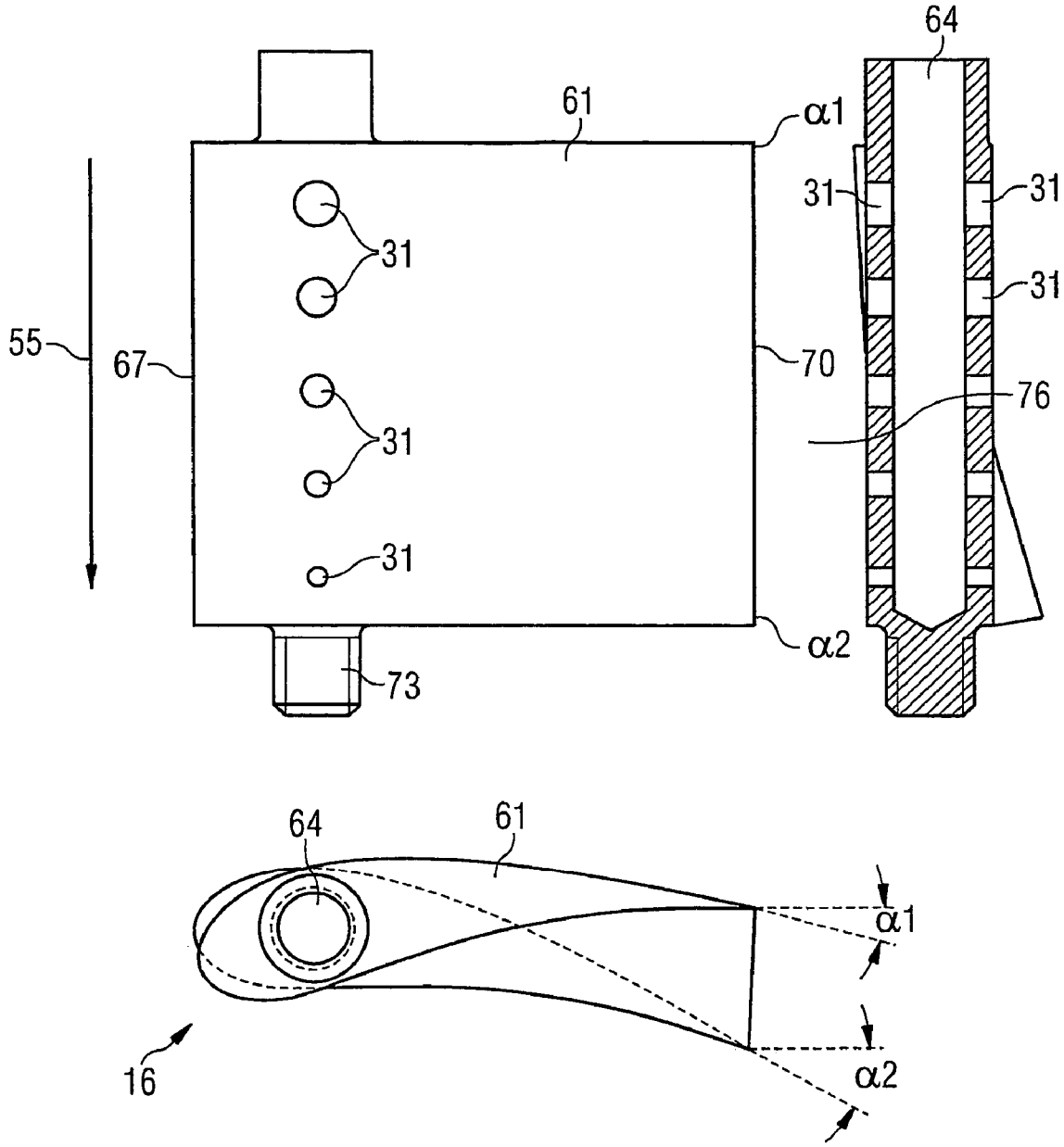
FIGS. 4*a*, 4*b* and 4*c* shows a swirl blade for a burner embodied according to the invention.

FIGS. 4*a*, 4*b* and 4*c* shows a further swirl blade 16 for a burner 1 according to the invention.

The swirl blade 16 is embodied for example in relation to the size and distribution of the fuel nozzles 31 like the swirl blade in FIGS. 3*a* and 3*b*

In addition, the bladed disk 61 may also be wound around a winding axis 76.

The winding axis 76 forms an intersecting angle not equal to zero with the flow direction 88 and lies in particular at 90°.

Viewed in the radial direction 55, a gas or a fuel-air mixture which flows past the swirl blade 16 from the leading edge 67 to the trailing edge 70 experiences different outflow angles α, i.e. a different outflow angle α1 is generated at one end of the swirl blade 16 in the area of the trailing edge 70 than at the other end, an outflow angle α2 (not equal to α1), viewed in the direction of a longitudinal axis of the supply 64. In particular the outflow angle α decreases linearly. A non-linear increase or decrease can also be present.

This distribution in the radial direction 55 of the outflow angle α also suppresses combustion instabilities, thereby extending the operating range for the burner 1.

In the channel 13, the medium flowing past the swirl blade 16 forms the outflow angle α with the flow direction 88 in the channel 13.

The swirl blade 16 can be wound and can also have different diameters for the fuel nozzles.

Figure 5:
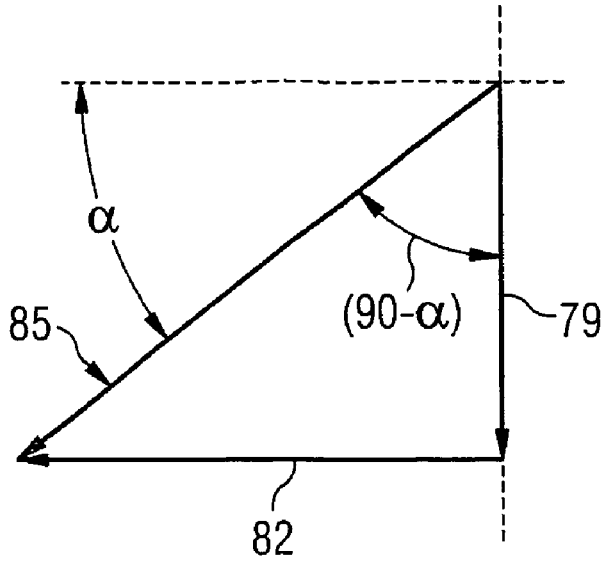
FIG. 5 shows velocity vectors of a flowing fuel air-gas mixture.

FIG. 5 shows the arrangement of the different flow vectors of the gas flowing in the channel 13. The vector 79 represents the meridional velocity component. The vector 82 represents the circumferential velocity, thereby yielding a resulting velocity sector 85. The angle between the resulting velocity 85 and the circumferential velocity 82 represents the outflow angle α. The angle 90°-α is the complementary angle.

The outflow angle α is also the angle between the flow direction of the flowing medium and a plane which runs perpendicularly to th e burner longitudinal axis 46.

The invention claimed is:

1. A burner, comprising:

a means for providing a flow of compressed air and/or oxygen in a flow direction through a channel;

a means for creating a mixture in the channel, the mixture comprising the flow of compressed air and/or oxygen and a fuel, the means for creating a mixture comprising fuel discharge openings arranged to create a concentration distribution of fuel within the mixture that is not constant across a distance defined along a length of a first axis which is oriented perpendicular to the flow direction in order to avoid combustion instabilities during operation of the burner; and a means for imparting a swirl to the mixture in the channel about the flow direction, the means for imparting swirl comprising a redirecting surface for redirecting the flow, wherein an outflow angle of the swirled mixture at a redirecting surface downstream end varies in magnitude in a single direction along a length of a second axis perpendicular to the flow direction.

2. The burner according to claim 1, wherein the burner has a burner longitudinal axis, and wherein the first axis intersects the burner longitudinal axis.

3. The burner according to claim 2, wherein the burner longitudinal axis represents an interior area of the burner, and the concentration distribution of the fuel decreases from the interior to an exterior portion of the burner located a distance away radially from the interior area.

4. The burner according to claim 1, wherein the channel is embodied annularly around a burner longitudinal axis.

5. The burner according to claim 4, wherein a fuel-gas mixture flows in the channel.

6. The burner according to claim 1, further comprising a diffusion or pilot burner arranged centrally along a burner longitudinal axis.

7. The burner according to claim 1, wherein the redirecting surface is a swirl blade.

8. The burner according to claim 7, wherein the fuel is supplied to the channel via a fuel nozzle in the swirl blade.

9. The burner according to claim 8, wherein the swirl blade has fuel nozzles with diameters that vary and produce the non-constant concentration distribution of the fuel.

10. The burner according to claim 9, wherein the burner has a burner longitudinal axis that represents an interior area of the burner and the burner has a radial direction disposed perpendicularly to the burner longitudinal axis, and the diameter of the fuel nozzles of an installed swirl blade decreases in the radial direction from the interior to an exterior portion of the burner located a distance away radially from the interior area.

* * * * *